US008468619B2

(12) United States Patent
Cen

(10) Patent No.: US 8,468,619 B2
(45) **Date of Patent: *Jun. 25, 2013**

(54) OPEN/CLOSE DEVICE OF A WASHING TANK DRAIN SYSTEM

(75) Inventor: Difeng Cen, Ningbo (CN)

(73) Assignee: Ningbo Bosheng Plumbing Co., Ltd., Ningbo, Zhejiang Province (CN)

( * ) Notice: Subject to any disclaimer, the term of this patent is extended or adjusted under 35 U.S.C. 154(b) by 396 days.

This patent is subject to a terminal disclaimer.

(21) Appl. No.: 12/811,825

(22) PCT Filed: Dec. 31, 2008

(86) PCT No.: PCT/CN2008/073897

§ 371 (c)(1),
(2), (4) Date: Jul. 6, 2010

(87) PCT Pub. No.: WO2009/089767

PCT Pub. Date: Jul. 23, 2009

(65) Prior Publication Data

US 2010/0282995 A1 Nov. 11, 2010

(30) Foreign Application Priority Data

Jan. 10, 2008 (CN) ..... 2008 1 0059102

(51) Int. Cl.
*E03C 1/23* (2006.01)

(52) U.S. Cl.
USPC ..... 4/689; 4/286

(58) Field of Classification Search
USPC ..... 4/286–295, 688–693
See application file for complete search history.

(56) References Cited

U.S. PATENT DOCUMENTS

| | | | | | |
|---|---|---|---|---|---|
| 3,002,196 | A * | 10/1961 | Mackey, Jr. | ..... | 4/689 |
| 4,596,057 | A * | 6/1986 | Ohta et al. | ..... | 4/689 |
| 4,956,529 | A * | 9/1990 | Ueno | ..... | 200/524 |
| 5,787,521 | A * | 8/1998 | O'Connell et al. | ..... | 4/689 |
| 5,822,812 | A * | 10/1998 | Worthington et al. | ..... | 4/689 |
| 6,023,795 | A * | 2/2000 | Potter et al. | ..... | 4/652 |
| 6,973,685 | B2 * | 12/2005 | Duncan | ..... | 4/689 |
| 7,886,372 | B2 * | 2/2011 | Jacobs | ..... | 4/295 |
| 2006/0156460 | A1 * | 7/2006 | Von Mertz et al. | ..... | 4/286 |
| 2009/0158522 | A1 * | 6/2009 | Wu | ..... | 4/689 |

* cited by examiner

*Primary Examiner* — Gregory Huson
*Assistant Examiner* — Janie Christiansen

(57) ABSTRACT

A open/close device of washing tank drain comprises an open/close controller having a sliding shaft and a fixed sleeve, a drain plug mechanism with an open/close function mechanism, and a connecting cable between the open/close controller and the open/close function mechanism. The open/close controller has a retaining hook to be connected with the sliding shaft. A first stop position and a second stop position, which are moveably connected with the retaining hook, are set on the surface of the sliding shaft, at different height, and the first one being closer to the head of the sliding shaft than the second one. The sliding shaft is provided with a first one-way slideway and a second one-way slideway. The open/close controller also has a spring for applying a force to the sliding shaft along the direction from the head to the tail of the sliding shaft. One end of the connecting cable is connected with the sliding shaft.

10 Claims, 7 Drawing Sheets

OPEN/CLOSE DEVICE OF A WASHING TANK DRAIN SYSTEM

BACKGROUND

1. Field of the Invention

The present invention relates to the washing tank field, especially, to an open/close device of the washing tank drain system.

2. Description of Related Arts

Currently, the ordinary open/close device of the washing tank drain is designed to be connected with a drain plug, so that users have to reach their hands into water to pull or press the plug in order to fulfill the action of opening or closing. Other open/close devices use some connecting mechanisms to connect the open/close part in the plug; thereby the connecting mechanisms bring about the open/close part of the plug to open or close the plug. However, this type of device has more complicated structure, and accordingly gets rise to inconvenient operation and extra work.

SUMMARY OF THE PRESENT INVENTION

The object of the present invention is to furnish an open/close device of the washing tank drain system, which can be operated more easily and has longer service life.

According to the present invention, the open/close device comprises an open/close controller and a drain plug mechanism with an open/close function mechanism; a connecting cable is set between the open/close controller and the open/close function mechanism of the drain plug mechanism. Said open/close controller has a sliding shaft, a fixed sleeve with a sliding through hole in it for allowing the sliding shaft to slide through, and a retaining hook for stopping the sliding shaft from moving; said sliding shaft has a first stop position and a second stop position on its surface in order to be movably engaged with the hook part of the retaining hook; said first stop position and second stop position are configured at the different height of the surface of the sliding shaft, the first stop position being closer to the head of the sliding shaft than the second stop position; a first one-way slideway is set on the surface of the sliding shaft allowing the sliding shaft to move from the point where the first stop position is movably engaged with the hook part of the retaining hook to the point where the second stop position is movably engaged with the hook part; a second one-way slideway is also set on the surface of the sliding shaft allowing the sliding shaft to move from the point where the second stop position is movably engaged with the hook part of the retaining hook to the point where the first stop position is movably engaged with the hook part; said first one-way slideway includes a first section of slideway starting from the first stop position and a second section of slideway connecting with the first section of slideway and leading to the second stop position, the connecting area being farther from the head of the sliding shaft than the second stop position; said second one-way slideway includes a third section of slideway starting from the second stop position and a fourth section of slideway connecting with the third section of slideway, the connecting area being farther from the head of the sliding shaft than the second stop position; said fourth section of slideway is connected through the first section of slideway or to the first stop position; said open/close controller is provided with a spring for holding the sliding shaft in the direction from the head to the tail of the sliding shaft; said connecting cable has one end connected with the sliding shaft of the open/close controller.

Various implementations may include one or more of the following advantages. For example, by pressing action, the sliding shaft can do up-and-down movement, and accordingly causes the connecting cable, and in turn the swing arm, to correspondingly move so as to open or close the drain plug; in addition, the sliding shaft will keep a fixed position once the up or down movement is fully finished, so that users don't have to hold it, which not only brings convenient usage, but also prolong the service life.

These and other objectives, features, and advantages of the present invention will become apparent from the following detailed description, the accompanying drawings, and the appended claims.

DETAILED DESCRIPTION OF PREFERRED EMBODIMENTS

Figure 3:
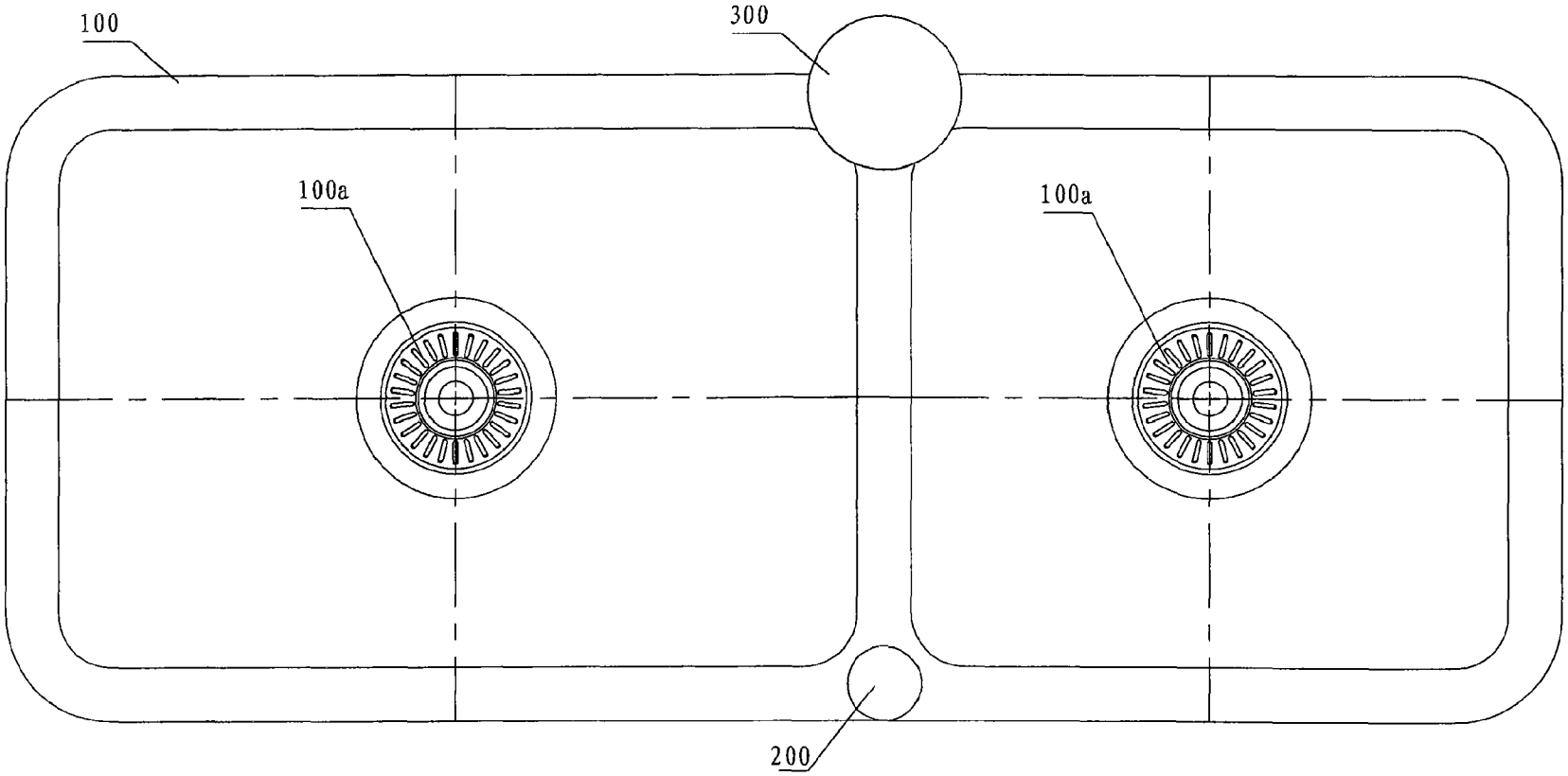
FIG. 3 is a bottom view of the present invention installed with the open/close controller shown in the FIG. 1.
Figure 4:
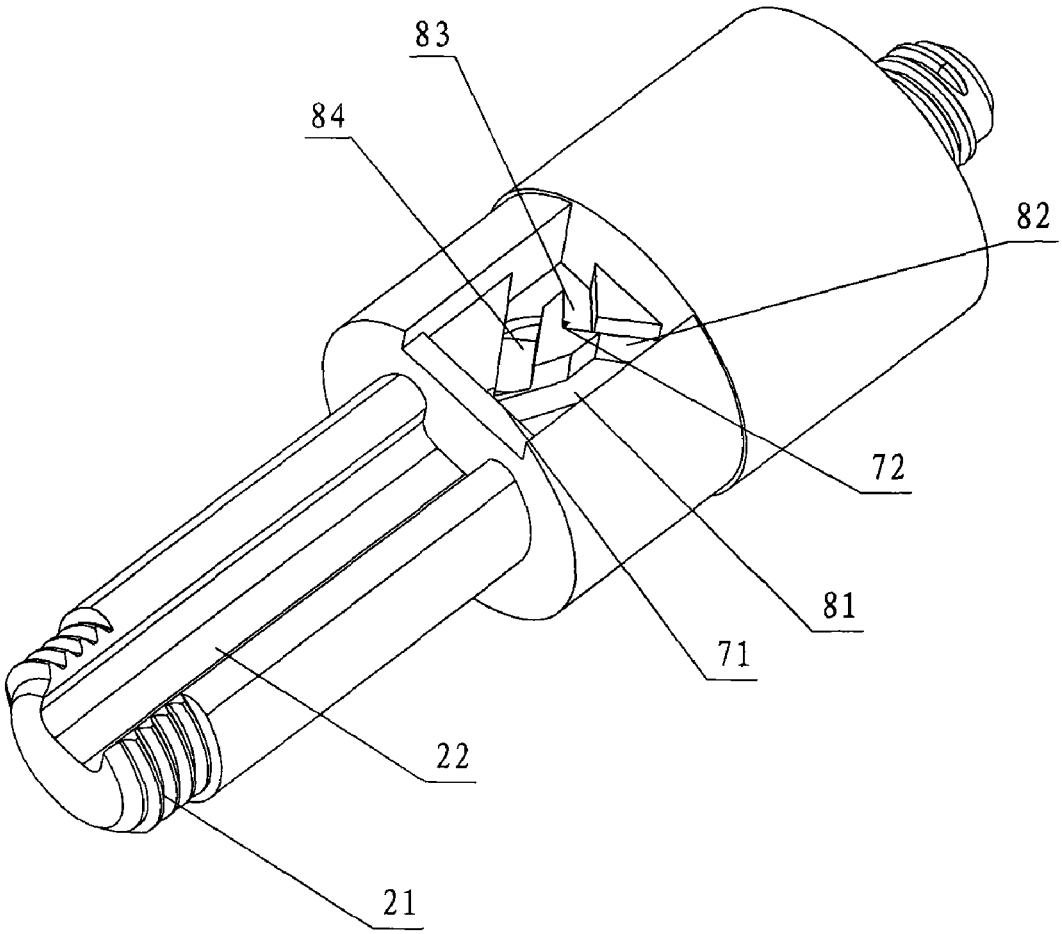
FIG. 4 is a schematic diagram of the sliding shaft shown in FIG. 1.

Since the present embodiment introduces a double-washing tank 100, two sets of open/close devices with the same structure, one is at left side and the other is at right side, are provided herein. Referring to FIG. 3, the numerical designator 200 represents the place to install an open/close controller; the numerical designator 300 represent the place to install a water faucet.

Referring to drawings, the present invention comprises an open/close controller and a drain plug mechanism 100*a* with an open/close function mechanism. A connecting cable 101 connects the open/close controller with the open/close function mechanism of the drain plug mechanism. 108 represents a fixed base for fixing the open/close controller in a washing tank; 109 is a ruber pad set between the fixed base and the washing tank. 110 is a nut connected via thread to the fixed base; 111 is a rubber pad set between the nut and the washing tank drain system.

Said open/close controller includes a sliding shaft 2 and a fixed sleeve with a sliding through hole 37 in it. In this embodiment, the tail of the sliding shaft is connected via thread with a button 1. The manner of connection might be different, such as make a rib and a corresponding groove onto the button and the tail of the sliding shaft, respectively. Said open/close controller has a spring 4 which can push the sliding shaft to move in the direction from the head 21 to the tail of the sliding shaft 4. Said connecting cable has an end connected with the sliding shaft 2 of the open/close controller.

In the present embodiment, said open/close function mechanism is a swing arm 102 which, by swinging movement, can open or close the plug mechanism 100*a* of the washing tank drain system. The other end of the connecting cable is connected with the free end 102*a* of said swing arm 102 and causes the swing arm to swing back and forth by pulling the free end. The numerical designator 103 represents the axis of rotation of the swing arm 102. Alternatively, it might also be done by installing a part having the same axis as the swing arm's and taking it as one part of the open/close function mechanism, like the swing arm, and having the part connected with the connecting cable to bring the swing arm to rotate around the axis. 100*b* is the ascending-descending guidance shaft of the drain plug mechanism, on which the free end of the swing arm acts. In addition, alternatively, said open/close function mechanism might be the one doing rectilinear motion, such as a mechanism provided with a part having a slope, the part being able to act on the ascending-descending guidance shaft 100*b*.

Figure 6:
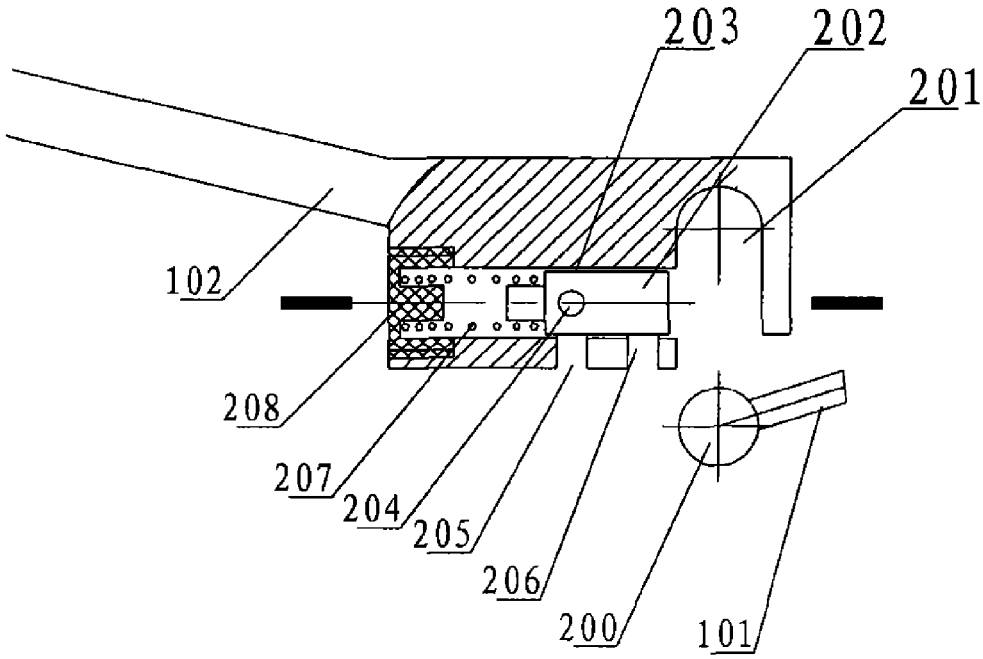
FIG. 6 is the schematic diagram of one embodiment of the connecting mechanism between the swing arm and the connecting cable.
Figure 7:
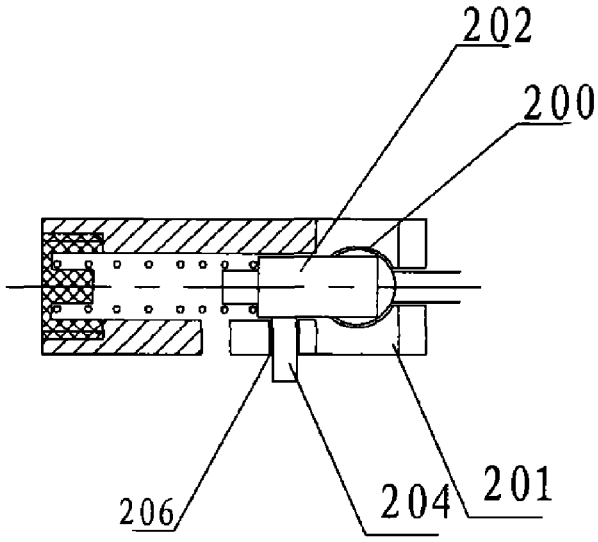
FIG. 7 is the schematic diagram of another embodiment of the connecting mechanism between the swing arm and the connecting cable.
Figure 8:
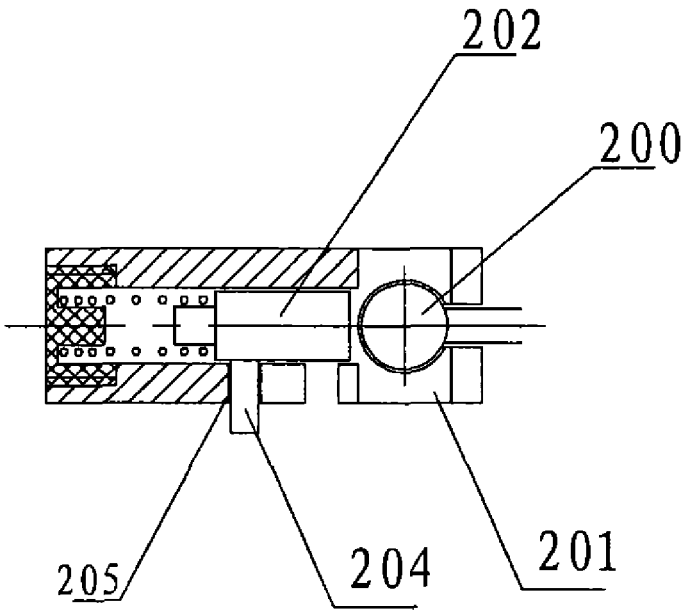
FIG. 8 is the schematic diagram of the third embodiment of the connecting mechanism between the swing arm and the connecing cable.

Referring to FIG. 6, FIG. 7 and FIG. 8, the present embodiment provides a structure which allows the swing arm and the connecting cable to connect with each other very conveniently and fast. The connecting cable 101 is provided with a joint ball 200 at its end tha is supposed to be connected to the swing arm. Said free end of the swing arm has a special locating hole 201 for placing said joint ball; in addition, said free end has a sliding block 202 for fixing the joint ball inside the locating hole. The numerical designator 203 represents a sliding groove for the sliding block 202.

The sliding block is provided with an operating button 204. The sliding block can do circumferential motion. Said free end of the swing arm has two locating slots, 205 and 206, and a spring 207 for acting on the sliding block. The numerical designator 208 represents the spring seat.

During installation, the operating button 204 is set by hand to make the sliding block move back. When the operating button 204 is moved to locating slot 205, the sliding block makes room for the locating hole 201; by slightly turning the operating button and in turn the sliding block, the operating button is moved to the locating slot 205 so as to be further located, and accordingly it becomes easy to put the joint ball 200 into the locating hole 201, which is shown in FIG. 7. By turning the operating button and in turn moving the sliding block again in order to move the operating button 204 out of the locating slot 205, the sliding block is going to move forward under the action of the spring 207; when the operating button goes to the locating slot 206, the sliding block will lock the joint ball 200 into the locating hole 201; next, by fine-tuning the operating button 204 and in turn slightly moving the sliding block, the operating button will be located in the locating slot 206, and therefore the connection between the swing arm and the connecting cable will be more reliable and stable, which state is shown in FIG. 8.

Said connecting cable can be an entire steel cable or comprise of several connected steel cables. Said connecting cable can be provided with a guidance mating member 101*a* for moving back and forth. This guidance mating member can cooperate with a guidance pipe 104 disposed in or out of the present device in order to guide the movement of the cable. A sealing ring 104*a* is set around the surface of the guidance mating member 101*a* for sealing the guidance mating member 101*a* from the guidance pipe 104. 105 is a screw cap connected with the guidance pipe 104. Said connecting cable might connect direct with the open/close controller and the open/close function mechanism of the plug mechanism of a washing tank system, or connect via other connecting parts.

A split nut 33 is used to connect the head of one end of the connecting cable to the head 21 of the sliding shaft. A rubber pad 330 is mounted at the top of the split nut 33 for shock absorption. The other end of the connecting cable is connected to the free end of the swing arm via grooves on the connecting member 102*b* connected with the swing arm and via corresponding grooves on the swing arm. The numerical designator 101*c* is a plastic sleeve covering the connecting cable. 106 is an adjusting screw between the plastic sleeve 101*c* and the spring installation sleeve 32 of a fixed sleeve. The adjusting screw is connected with the spring installation sleeve 32, and is used for fine tuning the length of the cable. The numerical designator 107 is a locknut connected via thread with the adjusting screw 106 and acts for tightening the adjusting screw.

Said fixed sleeve includes a guide sleeve 31 and the spring installation sleeve 32 which is connected with the bottom of the guide sleeve. Said spring 4 is installed inside the spring installation sleeve 32 and, with the bulge in the spring installation sleeve as a support, holds upward the head of the sliding shaft. Alternatively, the spring 4 can be set inside the guide sleeve 31 and holds upward other parts of the sliding shaft or holds the button. The spring can also be set outside all these sleeves mentioned above or put in any parts positioned in a proper place of the washing tank, as long as the sliding shaft can receive a force in the direction from the head to the end.

There is a connecting component 34 set in the fixed sleeve. The connecting component 34 is connected via thread with the guide sleeve and is passed through by the sliding shaft. In the present embodiment, the sliding shaft has a locating groove 22 along its axis direction, and correspondingly there is a circumferential location mechanism in the open/close device matching the locating groove, which is a locating raised part 35 on the connecting component. Alternatively, the locating groove can also be set on the fixed sleeve, and then the locating raised part is set in a corresponding place of the sliding haft. Besides, the circumferential location mechanism can adopt other forms used between the shaft and the sleeve.

Said open/close controller is provided with a retaining hook 6 for the sliding shaft; the retaining hook is connected to the locating raised part of said connecting component; therefore, the shape of the raised part can be utilized to match the retaining hook. There is a coil spring 36 provided outside the connecting component for fixing the retaining hook. The retaining hook can also be connected to the fixed sleeve or other fixed parts inside or outside the present device.

There is a first stop position 71 and second stop position 72 set on the surface of the sliding shaft, which is movably engaged with the hook part 60 of the retaining hook 6. The first stop position and second stop position is respectively configurated at a different height of the surface of the sliding shaft, with the first stop position being closer to the head 21 of the sliding shaft than the second stop position. A first one-way slideway is set on the surface of the sliding shaft that allows the sliding shaft to move from the point where the first stop position is movably engaged with the hook part of the retaining hook 60 to the point where the second stop position is movably engaged with the hook part. A second one-way slideway is also set on the surface of the sliding shaft that allows the sliding shaft to move from the point where the second stop position is movably engaged with the hook part of the retaining hook to the point, where the first stop position is movably engaged with the hook part. Said first one-way slideway includes a first section of slideway 81 starting from the first stop position and a second section of slideway 82 connecting with the first section of slideway and leading to the second stop position, the connecting area being farther from the head of the sliding shaft than the second stop position; said second one-way slideway includes a third section 83 of slideway starting from the second stop position and a fourth section 84 of slideway connecting with the third section of slideway, the connecting area being farther from the head of the sliding shaft than the second stop position; said fourth section of slideway is connected through the first section of slideway or connected to the first stop position.

Figure 5:
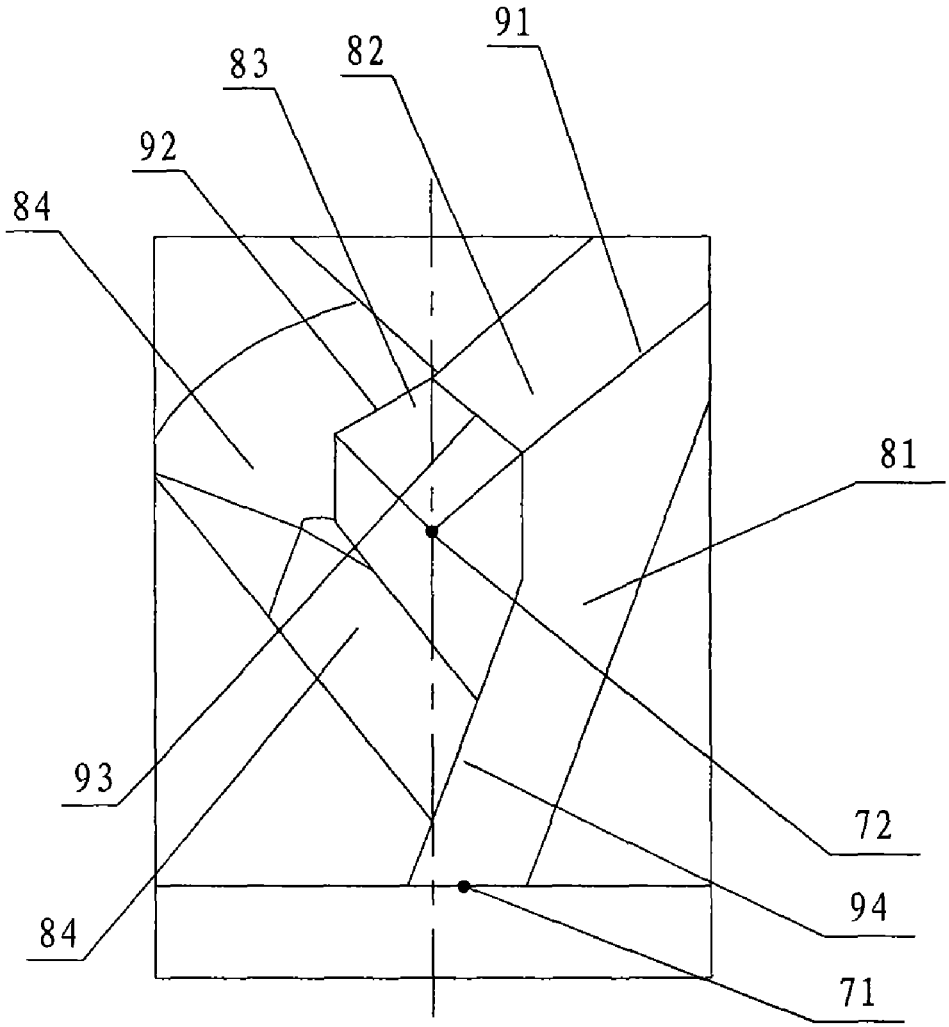
FIG. 5 is a front schematic diagram of sliding shaft at the area of one-way slideway and hooking positions.

To achieve one-way relative movement between the slideway mentioned above and the hook part 60 of the retaining hook, either the wall or the bottom of the slideway can be considered to do some work. The present embodiment introduces the bottom of the slideway to be worked on. Referring to FIG. 5, the first section of sideway 81 and the second section of sideway 82 connect with each other in a stepped manner, specifically at the joint 91; the bottom of the second section of slideway is lower than the bottom of the first section of slideway; the third section of slideway 83 and the fourth section of slideway 84 connect with each other in a stepped manner, specifically at the joint 92; the bottom of the fourth section of slideway is lower than the bottom of the third section of slideway; the second section of slideway has a downward step 93 at the place near to the second stop position; the fourth section slideway and the first section of slideway connect with each other in a stepped manner, specifically at the joint 94; the bottom of the first section of slideway is lower than the bottom of the fourth section of slideway.

By swing to a certain extent, the retaining hook can be movably engaged with the slideway of the sliding shaft. Alternatively, the sliding shaft can also be rotated at a certain angle in order to be movably engaged with the retaining hook, but which is less convenient than the former.

Figure 1:
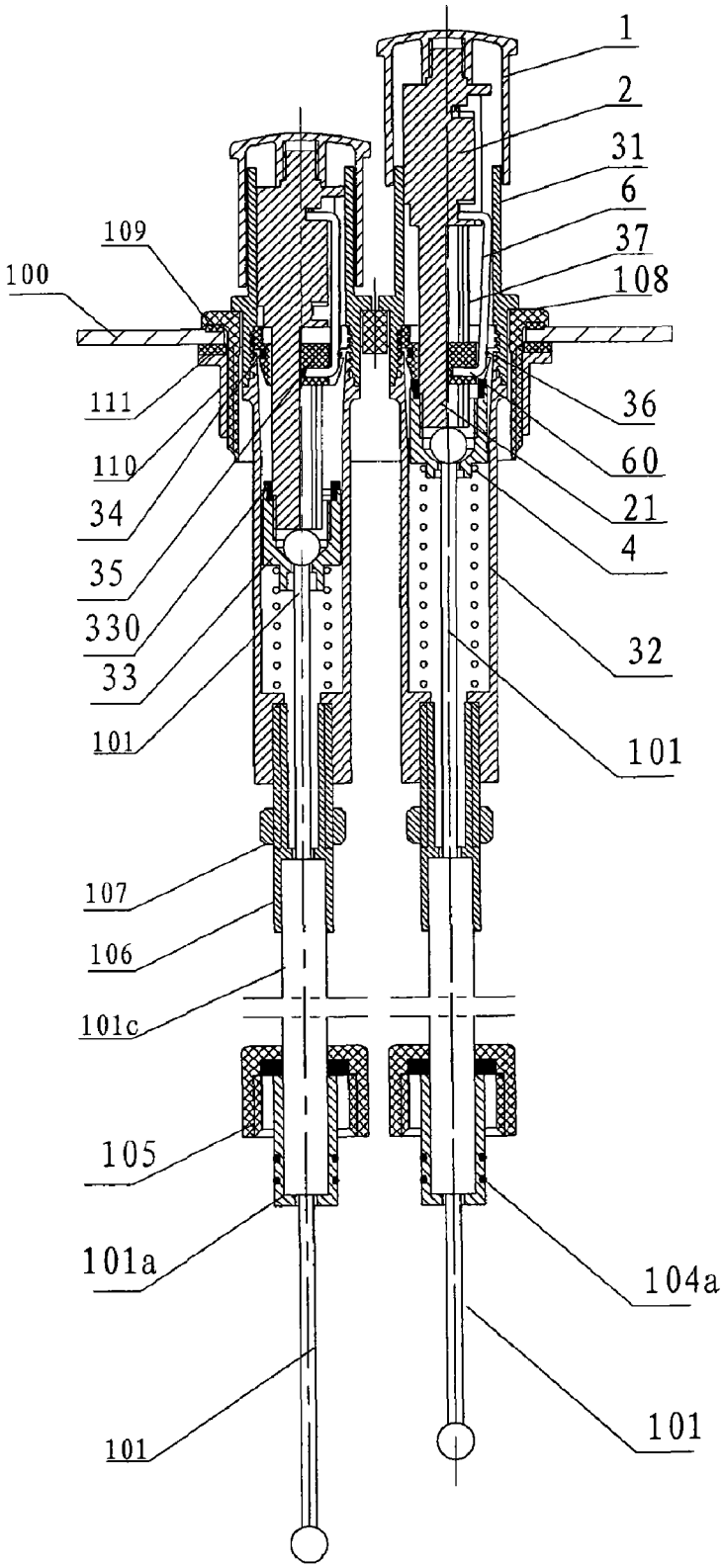
FIG. 1 is a sectional view of the open/close controller of the present invention applied to a double-washing tank.
Figure 2:
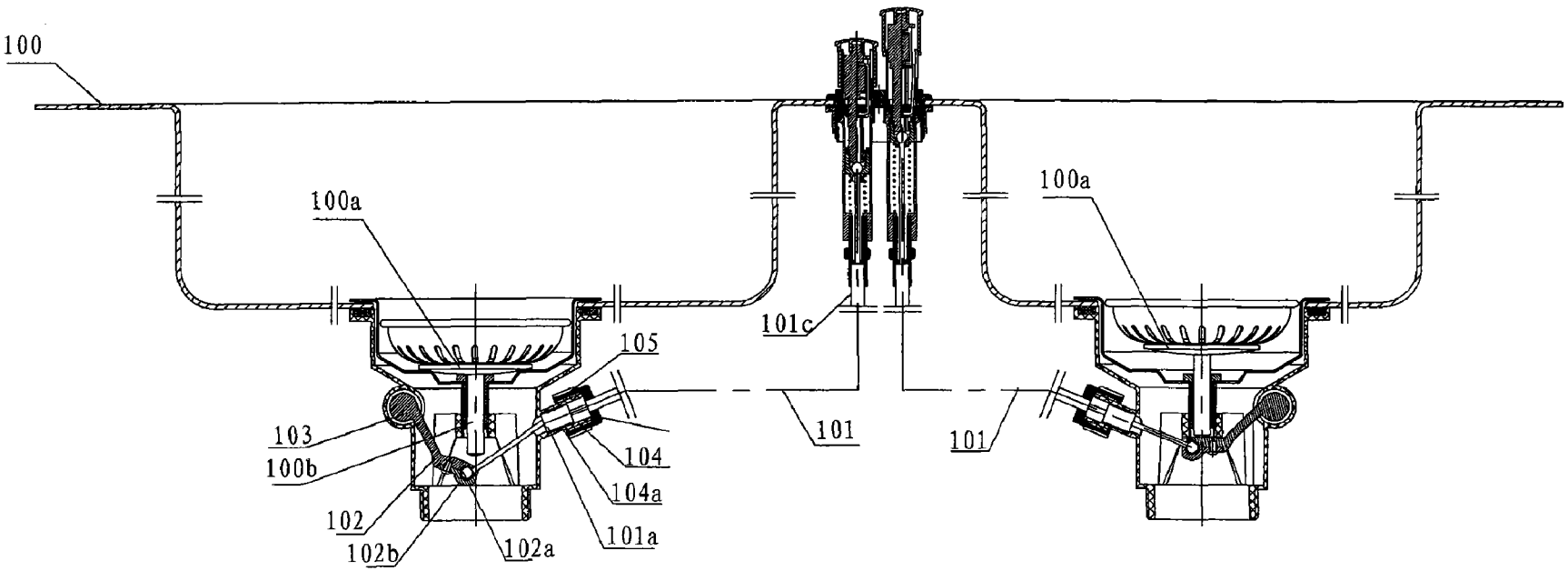
FIG. 2 is a general sectional view of the present invention installed with the open/close controller shown in the FIG. 1.

In operating, first, exert a force on the button 1 to bring about the sliding shaft 2 to move downward. At the moment, the retaining hook 6, under the action of coil spring 5, is located with its hooking end onto the connecting component, while the hooking body 60 is sliding upward from the first stop position and along the first section of slideway; when the pressing force is kept on the button 1, the hooking body 60 is going to get into the second section of slideway at the joint 91. When the button is released, the button, in virtue of the applied force of the spring 4, will make the sliding shaft move upward; however, because the first section of slideway and the second section of slideway connect through steps at joint 91, and the bottom of the second section of slideway is lower than the bottom of the first section of slideway, therefore the retaining hook is not able to backtrack, but only can go down along the second section of sideway to the second stop position area and further hook with the exact stop point of the second stop position, and accordingly fulfill the downward journey of the sliding shaft; at the same moment, the spring 4 is in a compressed state, which means the washing tank is in a water storing status and is illustrated in the left switch of FIG. 1 and FIG. 2. At that point, the connecting cable 101 stops pulling the swing arm 102, and then the swing arm rotates clockwise to get out of the ascending-descending guidance shaft 100*b*, and consequently the washing tank drain system gets into a closed state.

When the button is pressed down again, since the second section of slideway has a downward step at the place adjacent to the second stop position, the retaining hook is not able to backtrack, but goes upward along the third section of slideway and further gets into the fourth section of slideway. When the button is released, the force acted by the spring 4 causes the sliding shaft 2 to move upward; since the third and fourth section of slideway connect through steps at joint 92, and the bottom of the fourth is lower than the third one, the retaining hook is not able to backtrack, but can only goes downward along the fourth section of slideway to the first stop position, or goes downward along the fourth section of slideway in order to get into the first section of slideway and finally goes back to the first stop position and further hook with the first stop position, which means that the sliding shaft has finished the entire upward journey and the open/close controller has started the other status that is illustrated in the right open/close controller of FIG. 1 and FIG. 2. At the same moment, the connecting cable is tightening the swing arm, as illustrated in the left open/close controller of FIG. 1 and FIG. 2, and further causes the swing arm to rotate counterclockwise so as to lift the ascending-descending guidance shaft 100 up; therefore, the washing tank drain system gets into a open state.

One skilled in the art will understand that the embodiments of the present invention as shown in the drawings and described above is exemplary only and not intended to be limiting.

It will thus be seen that the objects of the present invention have been fully and effectively accomplished. Its embodiments have been shown and described for the purpose of illustrating the functional and structural principles of the present invention and is subject to change without departure from such principles. Therefore, this invention includes all modifications encompassed within the spirit and scope of the following claims.

What is claimed is:

1. An open/close device of washing tank drain system comprising:

an open/close controller having a sliding shaft, a fixed sleeve with a sliding through hole in it for allowing the sliding shaft to slide through and with a retaining hook on it for stopping the sliding shaft from moving, as well as a spring for applying a force to the sliding shaft along a direction from a head to a tail of the sliding shaft;

a drain plug mechanism with an open/close function mechanism; and a connecting cable provided between the open/close controller and the open/close function mechanism, one end of the connecting cable being connected with the sliding shaft of the open/close controller, wherein the sliding shaft is provided on a surface with:

a first stop position to be movably engaged with a hook part of the retaining hook;

a second stop position to be movably engaged with the hook part of the retaining hook, the second stop position and the first stop position are configured at a different height of the surface of the sliding shaft, the first stop position being closer to the head of the sliding shaft than the second stop position;

a first one-way slideway allowing the sliding shaft to move from a point where the first stop position is movably engaged with the hook part of the retaining hook to a point where the second stop position is movably engaged with the hook part, the first one-way slideway having a first section of slideway starting from the first stop position and a second section of slideway connecting with the first section of slideway and leading to the second stop position, their connecting area being farther from the head of the sliding shaft than the second stop position; and a second one-way slideway allowing the sliding shaft to move from the point where the second stop position is movably engaged with the hook part of the retaining hook to the point where the first stop position is movably engaged with the hook part, the second one-way slideway having a third section of slideway starting from the second stop position and a fourth section of slideway connected with the third section of slideway, their connecting area being farther from the head of the sliding shaft than the second stop position, wherein the fourth section of slideway is connected through the first section of slideway or is connected to the first stop position.

2. The open/close device of washing tank drain system as recited in claim 1, wherein the open/close function mechanism is a swing arm which opens or closes the drain plug mechanism by action of swing; the connecting cable has a second end connected with a free end of the swing arm; the second end of the connecting cable is provided with a joint ball; the free end of the swing arm is provided with a corresponding locating hole and a sliding block for locating the joint ball into the locating hole.

3. The open/close device of washing tank drain system as recited in claim 2, wherein the sliding block is provided with an operating button to make the sliding block do circumferential motion; the free end of the swing arm is provided with locating slots for locating the operating button and a spring for acting on the sliding block.

4. The open/close device of washing tank drain system as recited in claim 1, wherein the connecting cable has a guidance mating member with a sealing ring on its surface for guiding it to move back and forth.

5. The open/close device of washing tank drain system as recited in claim 1, wherein the connecting cable is connected with the head of the sliding shaft via a split nut, and a rubber pad is mounted at the top of the split nut.

6. The open/close device of washing tank drain system as recited in claim 1, wherein the first section of sideway and the second section of sideway connect with each other in a stepped manner, at a joint, a bottom of the second section of slideway is lower than a bottom of the first section of slideway;

the third section of slideway and the fourth section of slideway connect with each other in a stepped manner, at a joint, a bottom of the fourth section of slideway is lower than the bottom of the third section of slideway; the second section of slideway has a downward step at near the second stop position; the fourth section slideway and the first section of slideway connect with each other in a stepped manner, at a joint; the bottom of the first section of slideway is lower than the bottom of the fourth section of slideway.

7. The open/close device of washing tank drain system as recited in claim 1, wherein the fixed sleeve has a connecting component in it, through which the sliding shaft can pass; the retaining hook is connected onto the connecting component; coil springs are set outside the connecting component for fixing the retaining hook.

8. The open/close device of washing tank drain system as recited in claim 1, wherein the fixed sleeve comprises a guide sleeve for the sliding shaft and a joint sleeve connected with a bottom of the guide sleeve; a bottom of the joint sleeve is connected with a spring installation sleeve inside that the spring is installed.

9. The open/close device of washing tank drain system as recited in claim 1, wherein the open/close device is provided with a circumferential location mechanism of the sliding shaft; a locating groove is set along an axis of the sliding shaft in order to match the circumferential location mechanism.

10. The open/close device of washing tank drain system as recited in claim 7, wherein the sliding shaft is provided with a locating groove; correspondingly, the connecting component is provided with a locating raised part to match the locating groove.

* * * * *